US008286402B2

(12) United States Patent
Fleishman

(10) Patent No.: US 8,286,402 B2
(45) Date of Patent: Oct. 16, 2012

(54) SYSTEM OF INTERLOCKING BUILDING BLOCKS

(76) Inventor: Gregg Fleishman, Culver City, CA (US)

( * ) Notice: Subject to any disclaimer, the term of this patent is extended or adjusted under 35 U.S.C. 154(b) by 0 days.

(21) Appl. No.: 12/938,937

(22) Filed: Nov. 3, 2010

(65) Prior Publication Data

US 2011/0107706 A1 May 12, 2011

Related U.S. Application Data

(60) Provisional application No. 61/259,057, filed on Nov. 6, 2009.

(51) Int. Cl.
*E04B 2/00* (2006.01)
*A63H 33/12* (2006.01)

(52) U.S. Cl. ..... 52/588.1; 52/271; 52/604; 52/608; 446/109; 446/122

(58) Field of Classification Search ..... 52/271, 52/284, 574, 585.1, 586.1, 588.1, 604, 177, 52/608; 446/122, 124, 125, 105–106, 108–109, 446/112–115
See application file for complete search history.

(56) References Cited

U.S. PATENT DOCUMENTS

| | | | | | |
|---|---|---|---|---|---|
| 101,179 | A * | 3/1870 | Swift | 446/122 |
| 1,269,674 | A * | 6/1918 | Bacigalupo | 52/505 |
| 1,604,391 | A * | 10/1926 | Croy | 446/128 |
| 3,229,432 | A * | 1/1966 | Renfro | 52/293.2 |
| 3,368,316 | A * | 2/1968 | Crowder | 52/592.1 |
| 3,496,670 | A * | 2/1970 | Ryan et al. | 446/104 |
| 3,581,431 | A * | 6/1971 | Trenovan | 446/85 |
| 3,665,669 | A * | 5/1972 | Huber | 52/592.3 |
| 3,702,520 | A * | 11/1972 | Huber et al. | 52/284 |
| 4,429,506 | A * | 2/1984 | Henderson | 52/591.1 |
| 4,965,106 | A * | 10/1990 | DeChristopher | 428/34.2 |
| 5,281,185 | A * | 1/1994 | Lee | 446/488 |
| 5,329,737 | A * | 7/1994 | Roberts et al. | 52/245 |
| 5,662,508 | A * | 9/1997 | Smith | 446/128 |

* cited by examiner

*Primary Examiner* — Brian Glessner
*Assistant Examiner* — Adriana Figueroa
(74) *Attorney, Agent, or Firm* — Bruce A. Jagger

(57) ABSTRACT

A system of interlocking building blocks includes one or more building blocks having a generally right triangular planform, a generally rectangular elevation form, and a periphery generally defined by respective generally rectangular side panels. Each building block has alternating male and female fastener elements arrayed generally around the periphery. The male fastener elements on opposed edges of the same generally rectangular side panel are offset generally diagonally from one another. Each male fastener element is aligned generally normally with a female fastener element on an opposed edge of the same generally rectangular side panel. The building blocks may be formed by folding single flat sheets, and may be made from cardboard, plastic, metal or other conventional materials. Each building block may be coated or filled with structurally reinforcing or insulative material. Two interlocked building blocks may be geometrically distinctive in a manner which optimizes the system for simplified and efficient construction of walled and roofed structures.

14 Claims, 8 Drawing Sheets

SYSTEM OF INTERLOCKING BUILDING BLOCKS

RELATED APPLICATIONS

This application claims the benefit of U.S. provisional Application No. 61/259,057 filed Nov. 6, 2009, which provisional Application is hereby incorporated herein by reference as though fully set forth hereat.

TECHNICAL FIELD OF THE INVENTION

The present invention relates generally to the field of building blocks. More particularly, the invention concerns building blocks of complimentary geometry that include interlocking mating elements.

BACKGROUND OF THE INVENTION

Systems of cooperative mating building blocks are known. However, there continues to be a need for a system of building blocks which are exceptionally useful for constructing primary or precursor walled, roofed or habitable structures. Further, in the building construction arts, there continues to be a demand for systems of interlocking blocks that are more lightweight and can take on an initial form that is more volumetrically efficient for transportation to the construction site. Moreover, it is particularly desirable for such a system of blocks to enable the rapid construction of larger structural barriers and supports that can also interlock at various angles with respect to each other.

SUMMARY OF THE INVENTION

By way of summary, embodiments concern a system of interlocking building blocks comprising at least one building block having first and second generally right triangular panels. Each of the first and second generally right triangular panels is bounded by base, opposite, and diagonal edges. The first and second generally right triangular panels are spaced apart and generally edge joined to mating edges of base, opposite, and diagonal generally rectangular side panels, respectively. Each of the generally rectangular side panels has approximately the same width. The lengths of the generally rectangular side panels are approximately coextensive with the aforementioned edges of the first and second generally right triangular panels to which they are joined, wherein the building block has a generally rectangular elevation form, a generally right triangular plan form, and a periphery generally defined by its respective generally rectangular side panels.

Each building block also comprises alternating male and female fastener elements arrayed generally around the periphery generally along each of the mating edges. The male fastener elements on opposed edges of the same generally rectangular side panel are offset generally diagonally from one another, and each male fastener element is aligned generally normally with a female fastener element on an opposed edge of the same generally rectangular side panel.

In embodiments, the alternating male and female elements are arrayed in a pattern that is joiningly complimentary with alternating female and male fastener elements on a similar copy of the building block. In further embodiments, the male fastener elements are lockingly insertable into adjacent female fastener elements on a similar copy of the building block. Embodiments may include more than one male fastener element on each mating edge. The male and female fastener elements are typically adapted to being secured together by direct inter-engagement with one another.

In certain embodiments, the building block is formed from a single folded flat sheet. The building block may be hollow or not hollow. The building block may also be molded in one piece.

In embodiments, the system of interlocking building blocks may include a support beam located adjacent at least one of the generally rectangular side panels.

Embodiments commonly include a second building block that is substantially a copy of the building block discussed above, wherein the building block and the second building block are positioned adjacent one another with an edge of the first right triangular panel of the building block being adjacent an edge of the second right triangular panel of the second building block with a male fastener element in the building block received in a female fastener element in the second building block. In such embodiments, the building block and the second building block may be positioned adjacent one another with a base generally rectangular side panel of the building block adjacent to an opposite generally rectangular side panel of the second building block. Alternatively, the building block and the second building block may be positioned adjacent one another with a base generally rectangular side panel of the building block adjacent to a base generally rectangular side panel of the second building block. In certain embodiments, the building block may include an end flap adapted to being adherently affixed to a rectangular side panel of the second building block.

A structural barrier may be formed which comprises at least a building block and a second building block. In such an embodiment, the second building block is substantially a copy of the building block, and the building block and the second building block may be positioned adjacent one another with an edge of the first right triangular panel of the building block being adjacent an edge of the second right triangular panel of the second building block with a male fastener element in the building block received in a female fastener element in the second building block. Such an embodiment may include a third building block.

The third building block comprises third and fourth generally right triangular walls, each of the third and fourth generally right triangular walls is bounded by first, second, and third generally linear boundaries. The third and fourth generally right triangular walls are spaced apart and generally joined to mating generally linear boundaries of first, second, and third generally rectangular side walls, respectively. Each of the generally rectangular side walls has approximately the same width. The lengths of the generally rectangular side walls are approximately coextensive with the generally linear boundaries of the first and second generally right triangular walls to which they are joined, wherein the third building block has a generally rectangular elevation form, a generally right triangular plan form, and a circumference generally defined by the respective generally rectangular side walls.

The third building block also comprises alternating male and female attachment elements which are arrayed generally around the circumference generally along each of the mating generally linear boundaries. The male attachment elements on opposed generally linear boundaries of the same generally rectangular side wall are offset generally diagonally from one another. Each male attachment element is aligned generally normally with a female attachment element on an opposed edge of the same generally rectangular side wall. At least one of the first, second, and third generally rectangular side walls is about the same length as one of the base, opposite, and diagonal generally rectangular side panels. In embodiments, one of the building block and second building block is positioned adjacent the third building block with the generally rectangular side wall and the generally rectangular side panel that are of the same length positioned adjacent one another with at least one edge and one generally linear boundary being adjacent one another and with at least one male fastener element received in a female attachment element.

In certain embodiments forming a structural barrier, at least one of the first, second, and third generally rectangular sidewalls is a different length than the respective one of the base, opposite, and diagonal generally rectangular side panels. Further, the third building block may be located in a different plane than at least one of the building block and the second building block, in which case the building block and second building block may form a portion of a vertical wall section of a roofed structure while the third building block forms a portion of a roof of said roofed structure.

In embodiments in which multiple planar sections of one or more structural barriers are joined at an angle with respect to each other, such as in a roofed structure, the exposed edge joints between the planar sections may be filled in by way of vertical, horizontal or diagonal edge closures comprising alternating male and female fastener elements complimentary to those of the building blocks to which they are fastened.

BRIEF DESCRIPTION OF THE DRAWINGS

Further advantages of the present invention may become apparent to those skilled in the art with the benefit of the following detailed description of the preferred embodiments and upon reference to the accompanying drawings in which.

Figure 1:
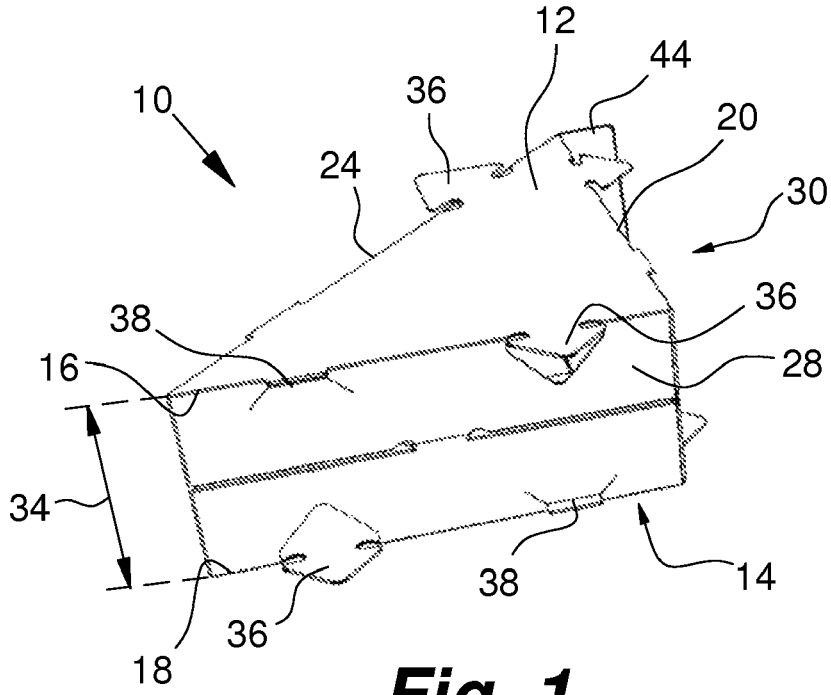
FIG. 1 is a perspective view of a building block in accordance with the present invention.

While the invention is susceptible to various modifications and alternative forms, specific embodiments thereof are shown by way of example in the drawings and may herein be described in detail. The drawings may not be to scale. It should be understood, however, that the drawings and detailed description thereto are not intended to limit the invention to the particular form disclosed, but on the contrary, the intention is to cover all modifications.

DETAILED DESCRIPTION OF THE INVENTION

Referring now to the drawings, like reference numerals designate identical or corresponding features throughout the several views.

Figure 2:
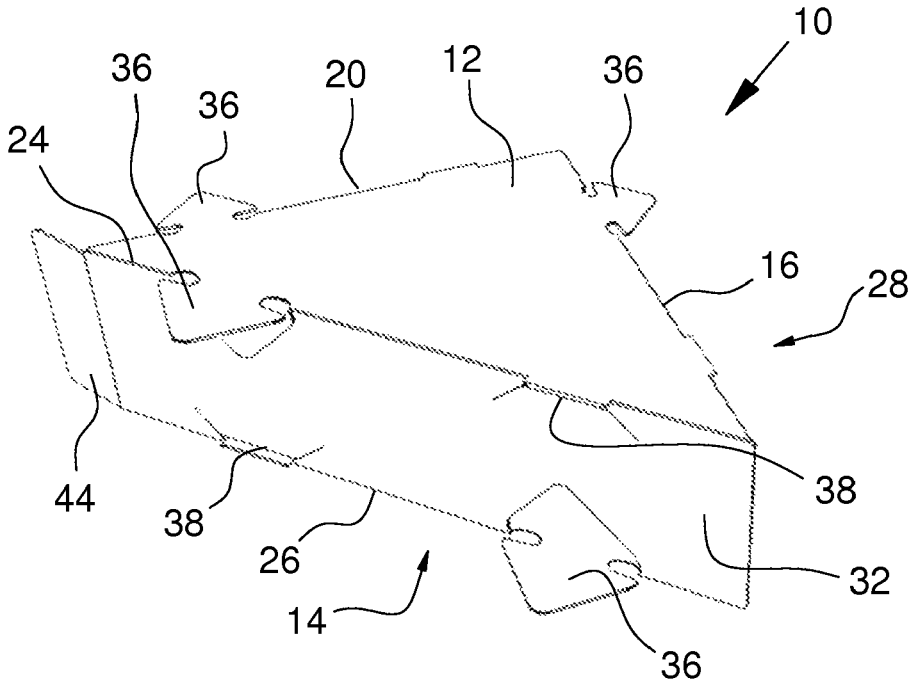
FIG. 2 is a further perspective view of the embodiment shown in FIG. 1.

Turning to FIGS. 1 and 2, a system of interlocking building blocks comprises at least one building block, examples of which are shown throughout several of the Figs. generally at 10. The building block 10 has first and second generally right triangular panels (examples of which are shown at 12 and 14, respectively). Each of the first and second generally right triangular panels 12 and 14 is bounded by a base, opposite, and diagonal edges. The first generally right triangular panel 12 is bounded by a base edge 16, an opposite edge 20, and a diagonal edge 24. Similarly, the second generally right triangular panel 14 is bounded by a base edge 18, an opposite edge 22, and a diagonal edge 26. The first and second generally right triangular panels 12 and 14 are spaced apart and generally edge joined to mating edges of a base generally rectangular side panel 28, an opposite generally rectangular side panel 30, and a diagonal generally rectangular side panel 32, respectively. Each of the generally rectangular side panels has approximately the same width 34. The lengths of the generally rectangular side panels are approximately coextensive with the aforementioned edges of the first and second generally right triangular panels to which they are joined, wherein the building block 10 has a generally rectangular elevation form, a generally right triangular plan form, and a periphery generally defined by its respective generally rectangular side panels 28, 30 and 32.

Each building block 10 also comprises alternating male and female fastener elements (examples of which are depicted at 36 and 38, respectively) arrayed generally around the periphery generally along each of the mating edges. The male fastener elements 36 on opposed edges of the same generally rectangular side panel are offset generally diagonally from one another, and each male fastener element 36 is aligned generally normally with a female fastener element 38 on an opposed edge of the same generally rectangular side panel.

Figure 3:
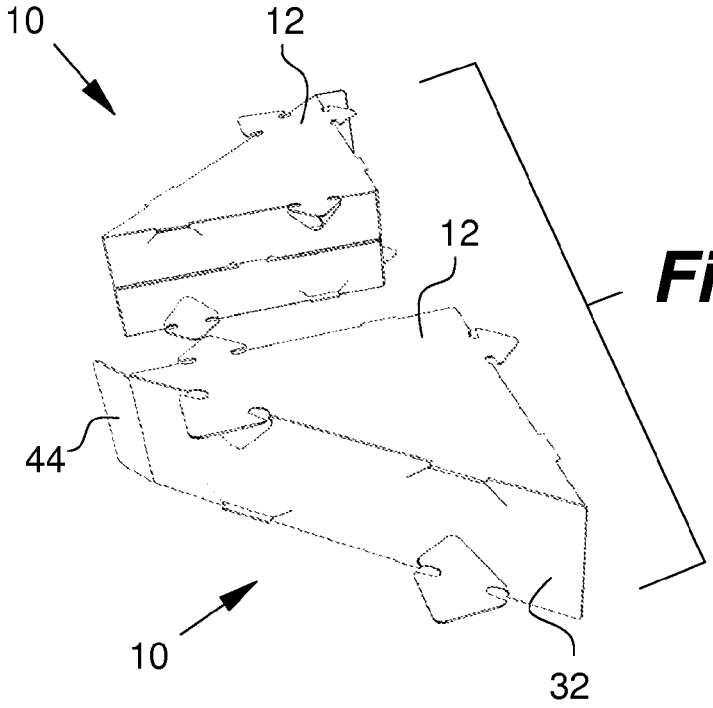
FIG. 3 is a perspective view of a building block and a second building block in accordance with the present invention prior to the inter-engagement of any of their respective male and female fastener elements.
Figure 4:
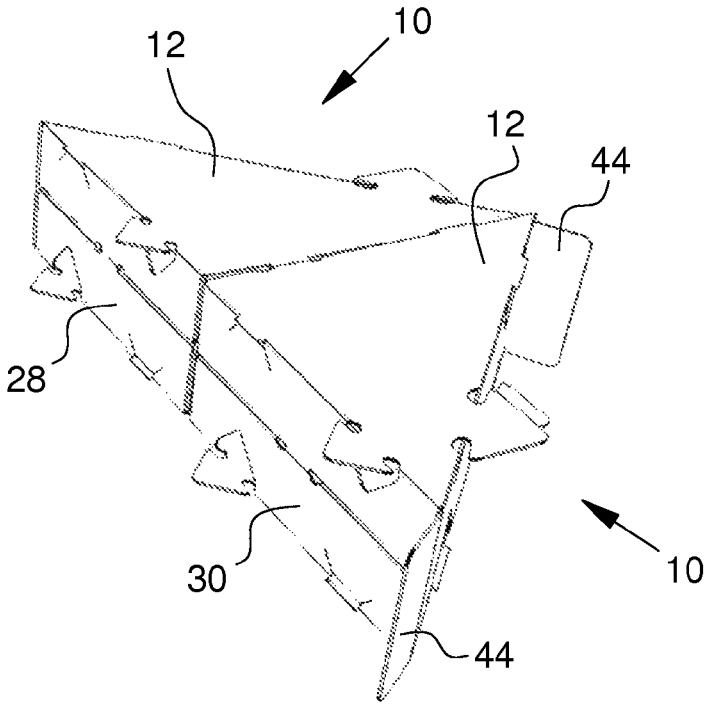
FIG. 4 is a perspective view of a building block and a second building block with their respective adjacent male and female fastener elements inter-engaged.
Figure 7:
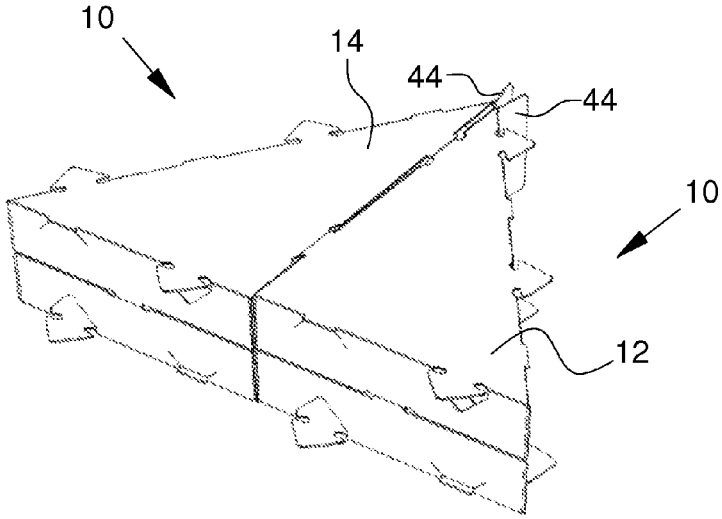
FIG. 7 is a perspective view of a building block and a second building block, each similar to the building block shown in FIG. 5, with their respective adjacent male and female fastener elements inter-engaged.

As illustrated, for example, in FIGS. 3, 4 and 7, in embodiments the alternating male and female elements (36 and 38, respectively) are arrayed in a pattern that is joiningly complimentary with alternating female and male fastener elements on a similar copy of the building block 10. The male fastener elements 36 are lockingly insertable into adjacent female fastener elements 38 on a similar copy of the building block 10. Embodiments may include more than one male fastener element 36 on each mating edge. The male and female fastener elements are typically adapted to being secured together by direct inter-engagement with one another, as depicted, for example, in FIGS. 4 and 7.

Figure 5:
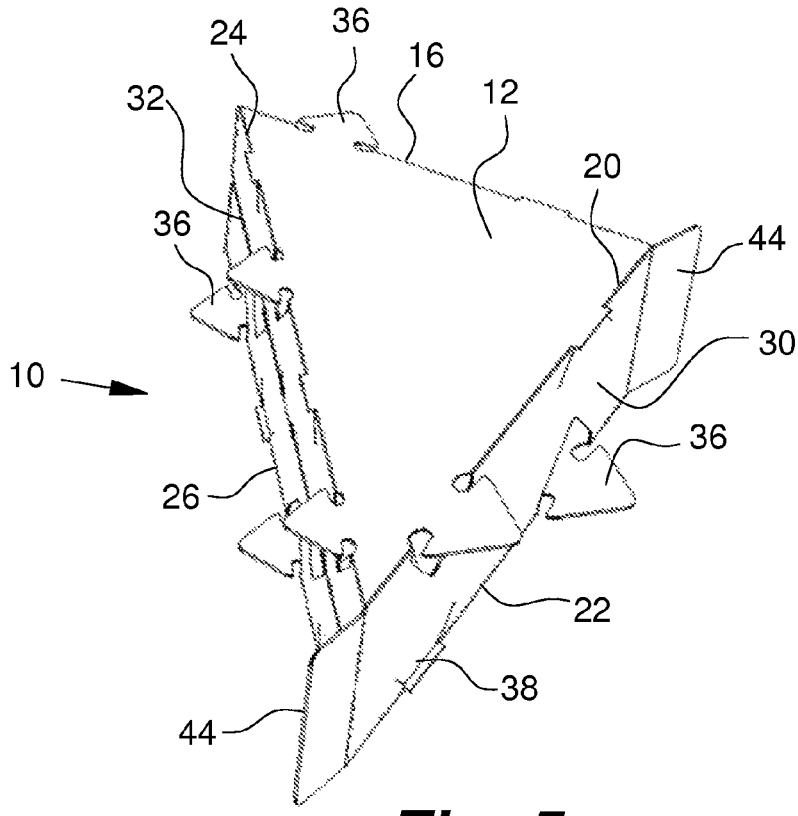
FIG. 5 is a perspective view of a further embodiment of a building block in accordance with the present invention.
Figure 6:
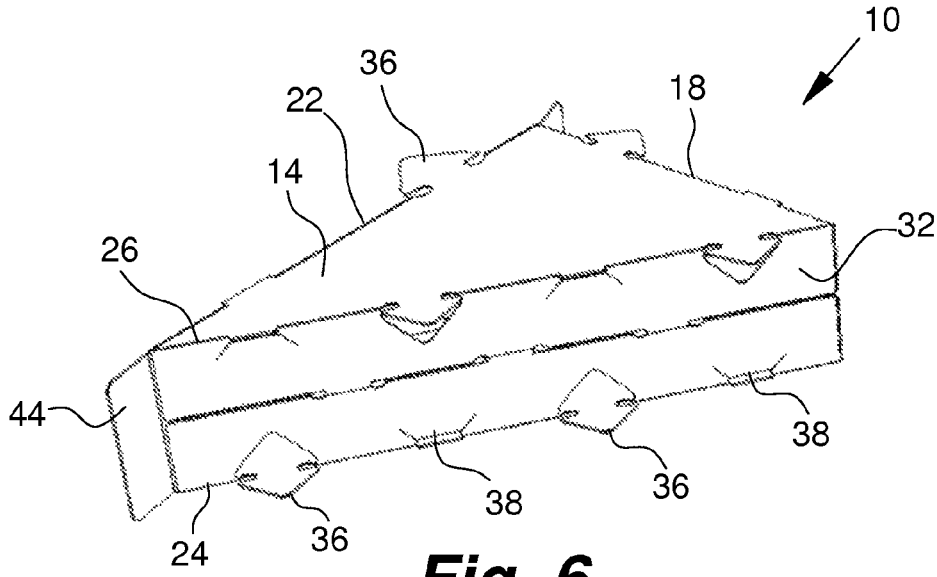
FIG. 6 is a further perspective view of the embodiment of a building block shown in FIG. 5.

The geometry of various building blocks 10 used in combination to form a single structure may differ. For example, in the embodiment of a building block 10 shown at FIGS. 1 and 2, the lengths of the base generally rectangular side panel 28 and the opposite generally rectangular side panel 30 are equal. As a result, in such a building block 10, when the base and opposite generally rectangular side panels 28 and 30 each have lengths of 1 unit, trigonometry dictates that the diagonal rectangular side panel 32 has a length of $\sqrt{2}$ units. See also FIG. 8. Conversely, in the embodiment of the building block 10 shown at FIGS. 5 and 6, the opposite generally rectangular side panel 30 has a length that is $\sqrt{2}$ times greater than that of the base generally rectangular side panel 28. As a result, in such a building block 10, when the base generally rectangular side panel 28 has a length of 1 unit, the opposite generally rectangular side panel has a length of $\sqrt{2}$ units, and the diagonal generally rectangular side panel has a length of $\sqrt{3}$ units. See also FIG. 9. As illustrated in FIGS. 10-12 and 16-17, the distinctions between these two configurations of building blocks 10 provide a particularly useful geometric relationship that enables the simplified construction of, for example, multiple walled roofed structures.

Figure 8:
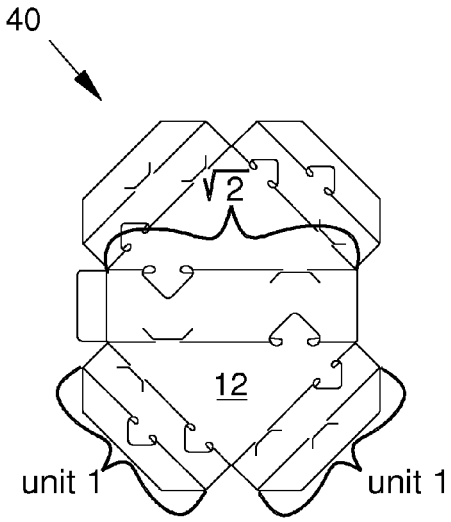
FIG. 8 is a planform view of a single flat sheet prior to its being folded to form the building block shown in FIG. 1.
Figure 9:
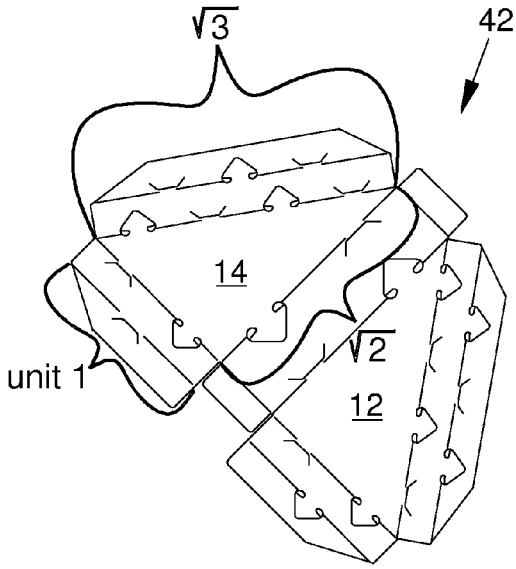
FIG. 9 is a planform view of a single flat sheet prior to its being folded to form the building block shown in FIG. 5.

Turning now to FIGS. 8 and 9, in certain embodiments, the building block 10 may be formed from a single folded flat sheet. The single flat sheet shown at 40 in FIG. 8, for example, is folded to form the building block shown at 10 in FIGS. 1 and 2. Similarly, the single flat sheet shown at 42 in FIG. 9, for example, is folded to form the building block shown at 10 in FIGS. 5 and 6. The single flat sheet which is the precursor (for example, 40 or 42) of the building block 10 can be, for example, die cut, laser cut or milled from conventional stock sheet materials such as, for example, cardboard, plastic or metal. The building block 10 may be hollow or not hollow. The building block 10 may also be blow molded as a single hollow piece. Further, either before or after multiple building blocks 10 have been interconnected, they may be coated with one or more layers of, for example, structurally reinforcing or insulative material. Alternatively or in addition, the building blocks 10 can each be filled internally with, for example, structurally reinforcing or insulative material. Moreover, to provide additional structural support and stiffness, building block 10 may include a support beam located adjacent at least one of the generally rectangular side panels 28, 30 and 32.

Turning to FIGS. 3, 4 and 7, embodiments commonly include a second building block 10. The second building block 10 is substantially a copy of the building block 10. For the purposes of interpreting the Figs., where a Fig. shows two items generally referred to at 10, it is intended that one is a building block 10 and the other is a second building block 10, although depending on the particular embodiment, they each may have identical or slightly different geometries. As shown, for example, in FIG. 7, the building block 10 and the second building block 10 may be positioned adjacent one another with an edge of the first right triangular panel 12 of the building block 10 being adjacent an edge of the second right triangular panel 14 of the second building block 10 with a male fastener element 36 in the building block 10 received in a female fastener element 38 in the second building block 10. In such embodiments, the building block 10 and the second building block 10 may be positioned adjacent one another with a base generally rectangular side panel 28 of the building block 10 adjacent to an opposite generally rectangular side panel 30 of the second building block 10. Alternatively, the building block 10 and the second building block 10 may be positioned adjacent one another with a base generally rectangular side panel 28 of the building block 10 adjacent to a base generally rectangular side panel 28 of the second building block 10. As shown, for example, in FIGS. 1-7, in certain embodiments, the building block 10 may include an end flap 44 adapted to being adherently affixed to a rectangular side panel (28, 30, or 32) of the second building block 10, thereby more permanently securing adjacent interlocked building blocks to one another.

Figure 10:
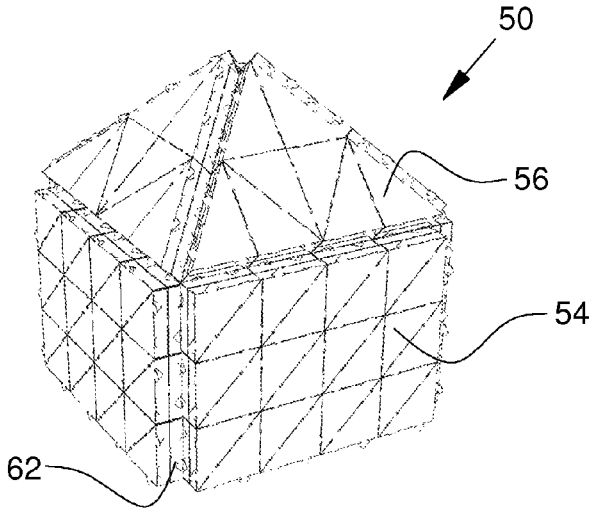
FIG. 10 is a perspective view of square-based roofed structure built from one or more structural barriers formed from one or more interlocked building blocks in accordance with the present invention.
Figure 11:
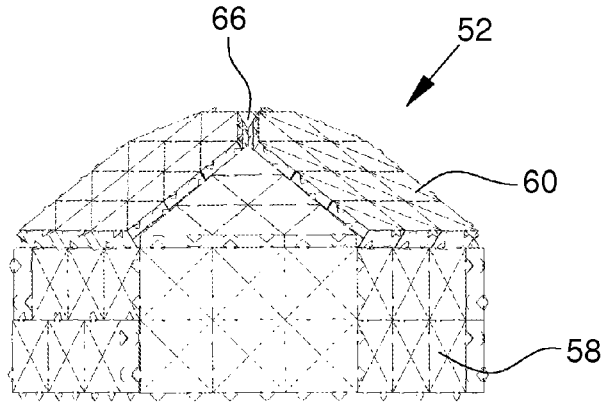
FIG. 11 is a side view of a hexagonal-based roofed structure built from one or more structural barriers formed from one or more interlocked building blocks in accordance with the present invention.
Figure 12:
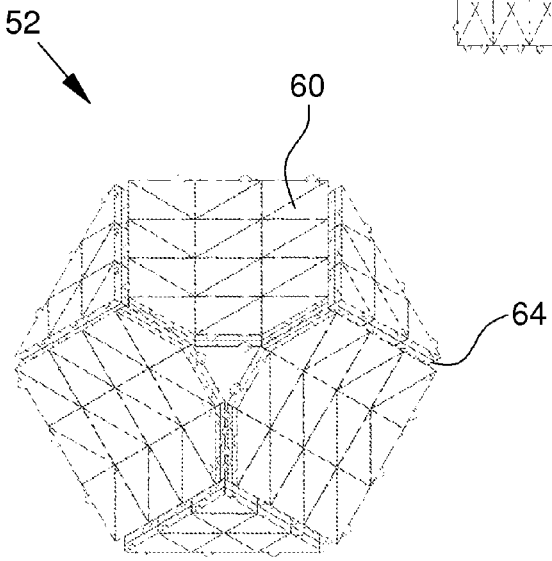
FIG. 12 is a top view of the hexagonal-based roofed structure shown in FIG. 11.

A structural barrier, such as those shown, for example, generally at 50 and 52 in FIGS. 10-12, may be formed which comprises at least a building block 10 and a second building block 10. In such an embodiment, the second building block 10 is substantially a copy of the building block 10, and the building block 10 and the second building block 10 may be positioned adjacent one another with an edge of the first right triangular panel 12 of the building block 10 being adjacent an edge of the second right triangular panel 14 of the second building block 10 with a male fastener element 36 in the building block 10 received in a female fastener element 38 in the second building block 10. Such an embodiment may include a third building block, which, for the purposes of the Figs. herein, is also shown generally at 10. The third building block may have identical or slightly different geometry from those of the building block 10 and the second building block 10.

It should be noted that some terms used herein to describe features of the third building block 10 are different from but correspond with terms used to describe equivalent features of the building block 10 and the second building block 10. That being said, returning to FIGS. 1, 2, 5, and 6 for illustration, the third building block 10 comprises third and fourth generally right triangular walls 12 and 14, respectively. Each of the third and fourth generally right triangular walls 12 and 14 is bounded by first, second, and third generally linear boundaries. Third generally right triangular wall 12 is bounded by a first generally linear boundary 16, a second generally linear boundary 20, and a third generally linear boundary 24. Similarly, the fourth generally right triangular wall 14 is bounded by a first generally linear boundary 18, a second generally linear boundary 22, and a third generally linear boundary 26. The third and fourth generally right triangular walls 12 and 14 are spaced apart and generally joined to mating generally linear boundaries of first generally rectangular side wall 28, second generally rectangular side wall 30 and third generally rectangular side wall 32, respectively. Each of the generally rectangular side walls has approximately the same width 34. The lengths of the generally rectangular side walls 28, 30 and 32 are approximately coextensive with the generally linear boundaries of the first and second generally right triangular walls 12 and 14 to which they are joined, wherein the third building block 10 has a generally rectangular elevation form, a generally right triangular plan form, and a circumference generally defined by the respective generally rectangular side walls 28, 30 and 32.

The third building block 10 also comprises alternating male and female attachment elements (shown at 36 and 38, respectively) which are arrayed generally around the circumference generally along each of the mating generally linear boundaries. The male attachment elements 36 on opposed generally linear boundaries of the same generally rectangular side wall are offset generally diagonally from one another. Each male attachment element 36 is aligned generally normally with a female attachment element 38 on an opposed edge of the same generally rectangular side wall. At least one of the first, second, and third generally rectangular side walls is about the same length as one of the base, opposite, and diagonal generally rectangular side panels. In embodiments, one of the building block 10 and second building block 10 is positioned adjacent the third building block 10 with the generally rectangular side wall and the generally rectangular side panel that are of the same length positioned adjacent one another with at least one edge and one generally linear boundary being adjacent one another and with at least one male fastener element 36 received in a female attachment element 38.

In certain embodiments forming a structural barrier, such as those shown generally at 50 and 52 in FIGS. 10-12, at least one of the first, second, and third generally rectangular side walls is a different length than the respective one of the base, opposite, and diagonal generally rectangular side panels.

Turning now to FIGS. 10-21, the third building block 10 may be located in a different plane than at least one of the building block 10 and the second building block 10, in which case the building block 10 and second building block 10 may form a portion of a planar section (54 or 58, for example) of a roofed structure (50 or 52, for example) while the third building block 10 forms a portion of another planar section (54 or 60, for example) of the roofed structure (50 or 52, for example).

Figure 16:
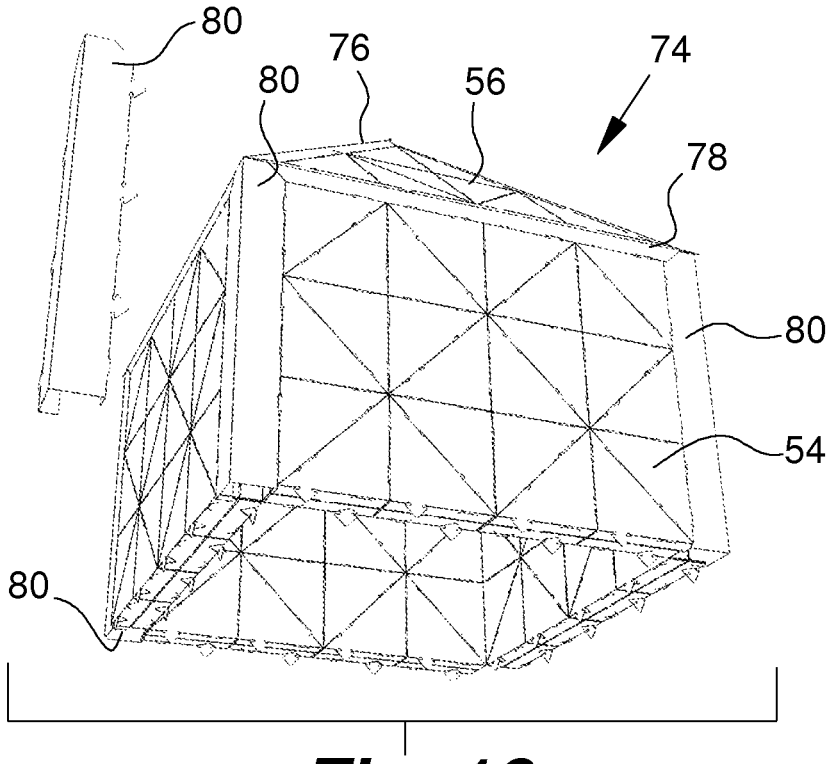
FIG. 16 is a perspective view of square-based roofed structure similar to that shown in FIG. 10, but with edge closures attached at the edge joints between planar sections of one or more structural barriers, one vertical such edge structure being shown removed from the square-based roof structure.
Figure 17:
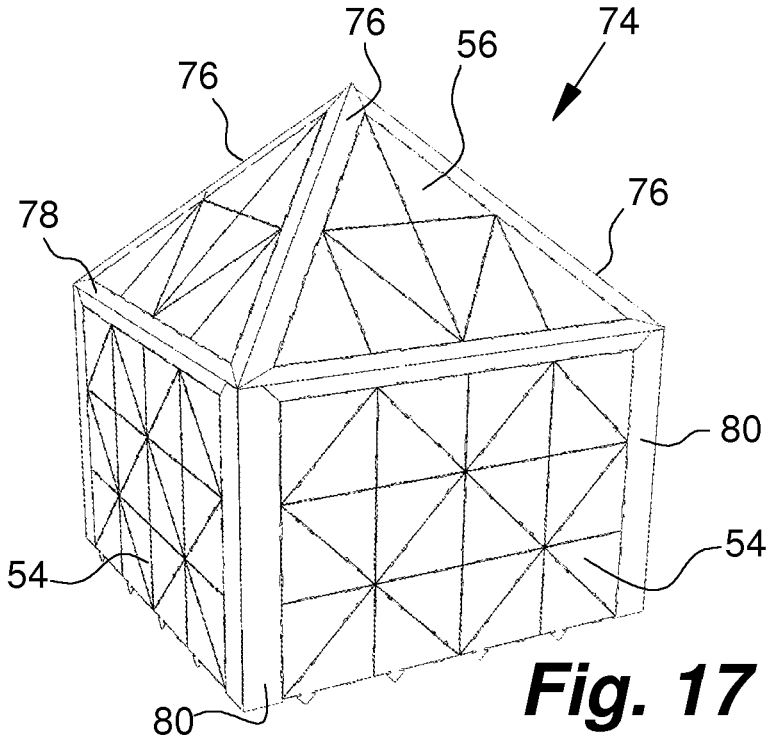
FIG. 17 is a further perspective view of the square-based roofed structure shown in FIG. 16, with all edge closures attached at the edge joints between the planar sections of one or more structural barriers.
Figure 18:
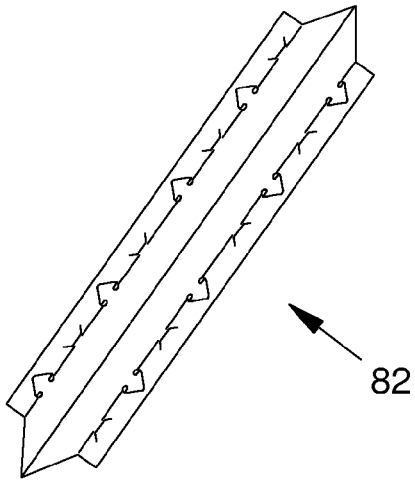
FIG. 18 is a planform view of a single flat sheet prior to its being folded to form a vertical edge closure such as those shown as part of the square-based roofed structure in FIG. 16.
Figure 19:
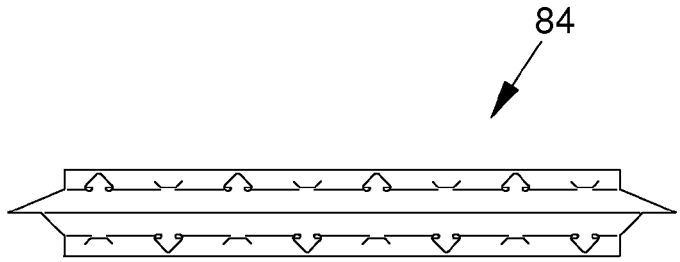
FIG. 19 is a planform view of a single flat sheet prior to its being folded to form a diagonal edge closure such as those shown as part of the square-based roofed structure in FIG. 17.
Figure 20:
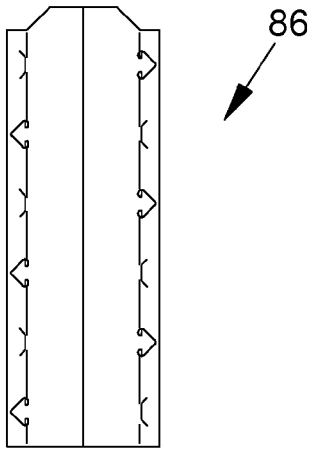
FIG. 20 is a planform view of a single flat sheet prior to its being folded to form a horizontal edge closure such as those shown as part of the square-based roofed structure in FIG. 17.

Turning to FIGS. 16 and 17, in embodiments in which multiple planar sections of one or more structural barriers are joined at an angle with respect to each other (such as in a roofed structures illustrated in FIGS. 10-12), the exposed edge joints 62, 64 and 66 between the planar sections (for example, 54, 56 and 60) may be filled in by way of vertical, horizontal or diagonal edge closures (shown, for example, generally at 76, 78 and 80), each of which comprises alternating male and female fastener elements complimentary to those of the building blocks 10 to which they are fastened. A roofed structure with which such edge closures are used is illustrated, for example, generally at 74. FIGS. 18-20 depict single flat sheets 82, 84, and 86 which are precursor structures designed to be folded to form vertical edge closure 76, horizontal edge closure 78 and diagonal edge closure 80, respectively.

Figure 13:
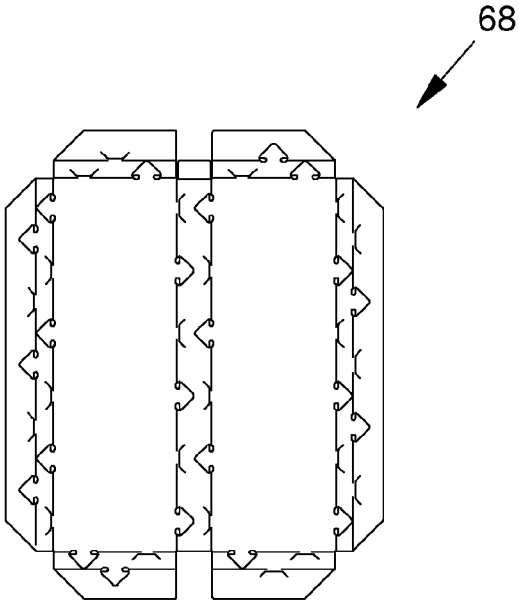
FIG. 13 is a planform view of a single flat sheet prior to its being folded to form a rectangular box structure including male and female fastener elements similar in form and arrangement to those of the triangular-shaped building blocks shown, for example, in FIG. 5.
Figure 14:
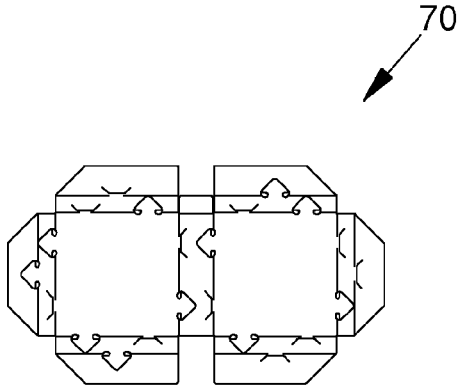
FIG. 14 is a planform view of a further single flat sheet prior to its being folded to form a further rectangular box structure including male and female fastener elements similar in form and arrangement to those of the triangular-shaped building blocks shown, for example, in FIG. 5.
Figure 15:
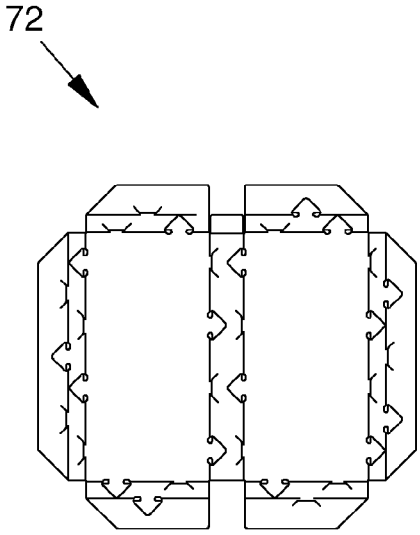
FIG. 15 is a planform view of a further single flat sheet prior to its being folded to form a further rectangular box structure including male and female fastener elements similar in form and arrangement to those of the triangular-shaped building blocks shown, for example, in FIG. 5.

FIGS. 13-15 depict single flat sheets 68, 70 and 72, each which are precursors designed to be folded to form rectangular building blocks with alternating male and female fastener elements 36 and 38, respectively, and each of which may be used independently or in association with the triangular-shaped building blocks described herein.

The detailed description of embodiments of a system of interlocking building blocks is intended to serve merely as examples, and is in no way intended to limit the scope of the appended claims to these described embodiments. Accordingly, modifications to the embodiments described are possible, and it should be clearly understood that the invention might be practiced in many different ways than the embodiments specifically described below, and still remain within the scope of the claims.

The invention claimed is:

1. A system of interlocking building blocks for use in constructing habitable structures comprising: a flat sheet folded into a building block and having:

first and second generally right triangular panels, each of said first and second generally right triangular panels being bounded by base, opposite, and diagonal edges, said first and second generally right triangular panels being spaced apart and generally edge joined to mating edges of base, opposite, and diagonal generally rectangular side panels, respectively, each of said generally rectangular side panels having approximately the same width, said generally rectangular side panels having lengths that are approximately coextensive with said edges of said first and second generally right triangular panels to which they are joined, wherein said building block has a generally rectangular elevation form, a generally right triangular plan form, and a periphery generally defined by said respective generally rectangular side panels;

and alternating male and female fastener elements integral with said flat sheet and arrayed generally around said periphery generally along each of said mating edges, said male fastener elements on opposed edges of the same said generally rectangular side panel being offset generally diagonally from one another, and each said male fastener element being aligned generally normally with said female fastener element on an opposed edge of the same said generally rectangular side panel, and an end flap projecting from said generally rectangular side panel to thereby extend said length of said generally rectangular side panel, said end flap being adapted to being adherently affixed to a surface of a generally rectangular side panel in an adjacent similar copy of said building block, said male fastener element on said building block adapted to being lockingly inserted into said female fastening element on said adjacent similar copy of said building block.

2. A system of interlocking building blocks as defined in claim 1 in which said alternating male and female fastener elements are arrayed in a pattern that is joiningly complimentary with alternating female and male fastener elements on a similar copy of said building block.

3. A system of interlocking building blocks as defined in claim 1 in which said building block is hollow.

4. A system of interlocking building blocks as defined in claim 1 including a support beam located adjacent at least one of said generally rectangular side panels.

5. A system of interlocking building blocks as defined in claim 1 including more than one said male fastener element on each said mating edge.

6. A system of interlocking building blocks as defined in claim 1 in which said building block is not hollow.

7. A system of interlocking building blocks as defined in claim 1 including a second building block that is substantially a copy of said building block, wherein said building block and said second building block are positioned adjacent one another with said edge of said first right triangular panel of said building block being adjacent a said edge of said second right triangular panel of said second building block.

8. A system of interlocking building blocks as defined in claim 7 in which said building block and said second building block are positioned adjacent one another with said base generally rectangular side panel of said building block adjacent to an opposite generally rectangular side panel of said second building block.

9. A system of interlocking building blocks as defined in claim 7 in which said building block and said second building block are positioned adjacent one another with said base generally rectangular side panel of said building block adjacent to a base generally rectangular side panel of said second building block.

10. A system of interlocking building blocks adapted for use in constructing habitable structures comprised of at least a building block and a second building block, in which each of said building block and said second building block is formed from a flat sheet, said building block comprises first and second generally right triangular panels, each of said first and second generally right triangular panels being bounded by base, opposite, and diagonal edges, said first and second generally right triangular panels being spaced apart and generally edge joined to mating edges of base, opposite, and diagonal generally rectangular side panels, respectively, each of said generally rectangular side panels having approximately the same width, said generally rectangular side panels having lengths that are approximately coextensive with said edges of said first and second generally right triangular panels to which they are joined, wherein said building block has a generally rectangular elevation form, a generally right triangular plan form, and a periphery generally defined by respective said generally rectangular side panels;

and alternating male and female fastener elements integral with said flat sheet and arrayed generally around said periphery generally along each of said mating edges, said male fastener elements on opposed edges of the same said generally rectangular side panel being offset generally diagonally from one another, and each said male fastener element being aligned generally normally with said female fastener element on an opposed edge of the same said generally rectangular side panel, the length of a said generally rectangular side panel being extended as an end flap; and said second building block comprises substantially a copy of said building block, wherein said building block and said second building block are positioned adjacent one another with said edge of said first right triangular panel of said building block being adjacent said edge of said second right triangle in said second building block with said male fastener element in said building block lockingly received in said female fastener element in said second building block, said end flap being adherently affixed to said rectangular side panel of said second building block.

11. A system of interlocking building blocks of claim 10 including a third building block, said third building block comprising third and fourth generally right triangular walls, each of said third and fourth generally right triangular walls being bounded by first, second, and third generally linear boundaries, said third and fourth generally right triangular walls being spaced apart and generally joined to mating generally linear boundaries of first, second, and third generally rectangular side walls, respectively, each of said generally rectangular side walls having approximately the same width, the lengths of the said generally rectangular side walls being approximately coextensive with said generally linear boundaries of said first and second generally right triangular walls to which they are joined, wherein said third building block has a generally rectangular elevation form, a generally right triangular plan form, and a circumference generally defined by said respective generally rectangular side walls;

alternating male and female attachment elements arrayed generally around said circumference generally along each of said mating generally linear boundaries, said male attachment elements on opposed generally linear boundaries of the same said generally rectangular side wall being offset generally diagonally from one another, and each said male attachment element being aligned generally normally with a said female attachment element on an opposed edge of the same said generally rectangular side wall;

at least one of said first, second, and third generally rectangular side walls being about the same length as one of said base, opposite, and diagonal generally rectangular side panels;

wherein one of said building block and second building block is positioned adjacent said third building block with the generally rectangular side wall and the generally rectangular side panel that are of the same length positioned adjacent one another with at least one edge and one generally linear boundary being adjacent one another.

12. A system of interlocking building blocks as defined in claim 11 in which at least one of said first, second, and third generally rectangular side walls is a different length than the respective one of said base, opposite, and diagonal generally rectangular side panels.

13. A system of interlocking building blocks as defined in claim 11 in which said third building block is located in a different plane than at least one of said building block and said second building block.

14. A system of interlocking building blocks as defined in claim 13 in which said building block and said second building block form a portion of a vertical wall section of a roofed structure and said third building block forms a portion of a roof of said roofed structure.

* * * * *